US011067917B2

(12) United States Patent
Hong et al.

(10) Patent No.: US 11,067,917 B2
(45) Date of Patent: Jul. 20, 2021

(54) DETECTING COMPLETION OF INJECTION OF TONER OF TONER REFILL CARTRIDGE

(71) Applicant: HEWLETT-PACKARD DEVELOPMENT COMPANY, L.P., Spring, TX (US)

(72) Inventors: Jinhwa Hong, Seoul (KR); SeungSup Lee, Suwon-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/050,068

(22) PCT Filed: Feb. 28, 2019

(86) PCT No.: PCT/US2019/019987

§ 371 (c)(1),
(2) Date: Oct. 23, 2020

(87) PCT Pub. No.: WO2020/046417

PCT Pub. Date: Mar. 5, 2020

(65) Prior Publication Data

US 2021/0080863 A1 Mar. 18, 2021

(30) Foreign Application Priority Data

Aug. 30, 2018 (KR) ..... 10-2018-0102536

(51) Int. Cl.
*G03G 15/08* (2006.01)

(52) U.S. Cl.
CPC ..... *G03G 15/0863* (2013.01); *G03G 15/0867* (2013.01); *G03G 15/0877* (2013.01)

(58) Field of Classification Search
CPC ..... G03G 15/0863; G03G 15/0867; G03G 15/0877; G03G 15/0879
USPC ..... 399/106, 119, 120, 256, 262
See application file for complete search history.

(56) References Cited

U.S. PATENT DOCUMENTS

| | | | | |
|---|---|---|---|---|
| 6,862,420 | B1 | 3/2005 | Less | |
| RE42,312 | E | 4/2011 | Umezawa et al. | |
| 8,565,649 | B2 * | 10/2013 | Murakami | G03G 15/0872 399/258 |
| 8,995,886 | B2 * | 3/2015 | Kim | G03G 15/0855 399/258 |

FOREIGN PATENT DOCUMENTS

| | | |
|---|---|---|
| JP | 8-6370 | 1/1996 |
| JP | 2002-341639 | 11/2002 |
| KR | 10-0498053 | 6/2005 |

(Continued)

*Primary Examiner* — Hoan H Tran
(74) *Attorney, Agent, or Firm* — Staas & Halsey LLP

(57) ABSTRACT

A toner refill cartridge includes a body in which toner is accommodated, a plunger inserted into the body and movably coupled to the body in a longitudinal direction of the body to push the toner out of the body, a toner injection completion signal generator used to detect toner injection completion according to movement of the plunger, and a connection interface located at a tip portion of the body and connectable to an image forming apparatus to transfer information about a toner refill cartridge to the image forming apparatus.

15 Claims, 11 Drawing Sheets

(56) References Cited

FOREIGN PATENT DOCUMENTS

| | | |
|---|---|---|
| KR | 10-0961094 | 5/2010 |
| KR | 10-2010-0108087 | 10/2010 |
| KR | 10-2014-0084766 | 7/2014 |
| KR | 10-1799088 | 11/2017 |

* cited by examiner

DETECTING COMPLETION OF INJECTION OF TONER OF TONER REFILL CARTRIDGE

CROSS REFERENCE TO RELATED APPLICATIONS

This application is filed under 35 U.S.C. 0.371 as a National Stage of PCT International Application No. PCT/US2019/019987, filed on Feb. 28, 2019, in the U.S. Patent and Trademark Office, which claims the priority benefit of Korean Patent Application No. 10-2018-0102536, filed on Aug. 30, 2018, in the Korean Intellectual Property Office. The disclosures of PCT International Application No. PCT/US2019/019987 and Korean Patent Application No. 10-2018-0102536 are incorporated by reference herein in their entireties.

BACKGROUND

An image forming apparatus using an electrophotographic method is an apparatus that supplies toner to an electrostatic latent image formed on a photoconductor to form a visible toner image on the photoconductor, transfers the toner image to a print medium via an intermediate transfer medium or directly to a print medium, and then fixes the transferred toner image on the print medium.

A development cartridge accommodates toner and supplies the toner to an electrostatic latent image formed on the photoconductor to form a visible toner image. When the toner accommodated in the development cartridge is exhausted, the development cartridge is removed from a main body of the image forming apparatus and a new development cartridge may be mounted on the main body of the image forming apparatus.

DETAILED DESCRIPTION

Figure 1:
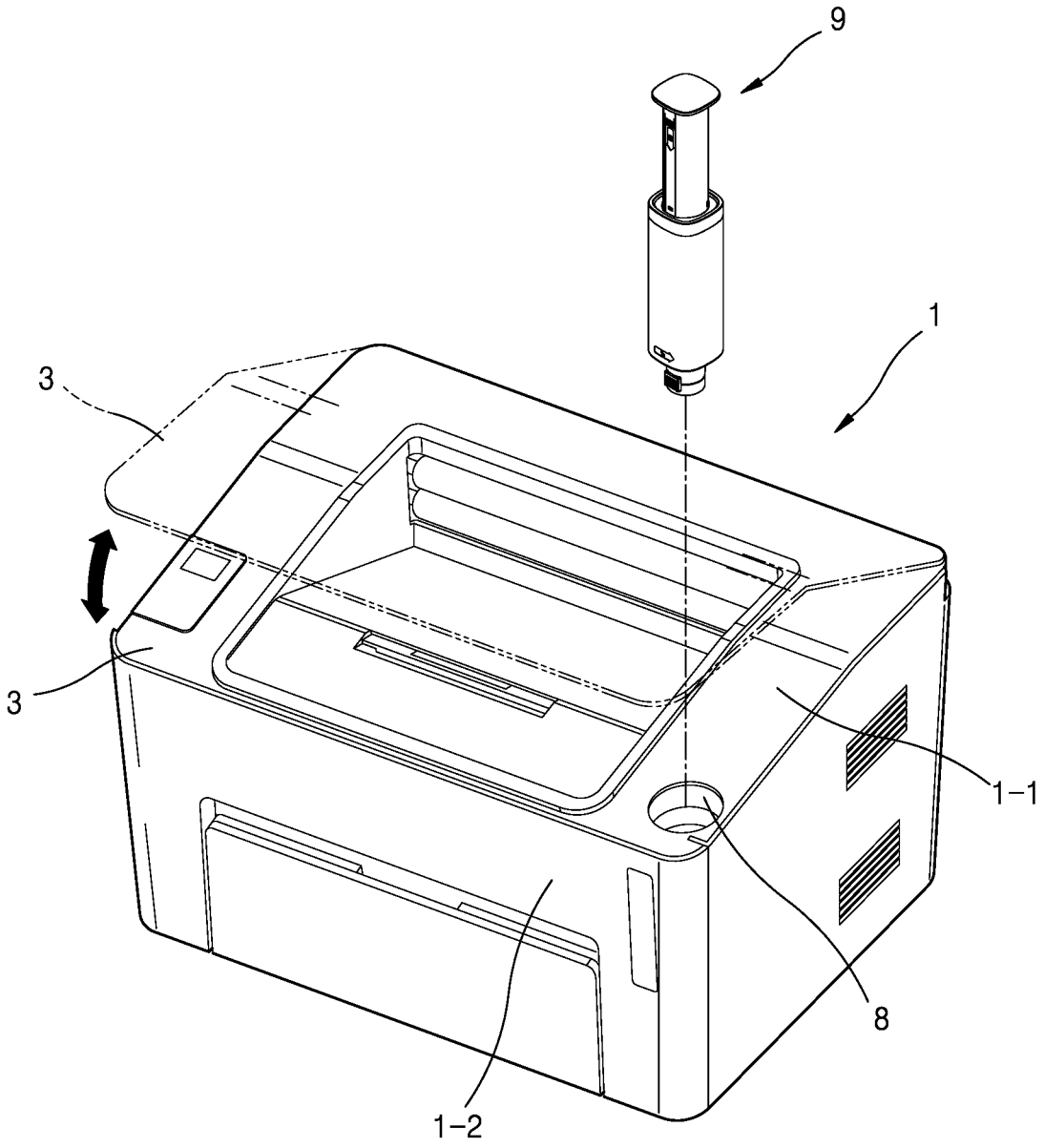
FIG. 1 is an external perspective view of an example of an electrophotographic image forming apparatus.

Reference will now be made in detail to examples which are illustrated in the accompanying drawings. The same reference numerals are used to denote the same elements, and repeated descriptions thereof will be omitted.

Figure 2:
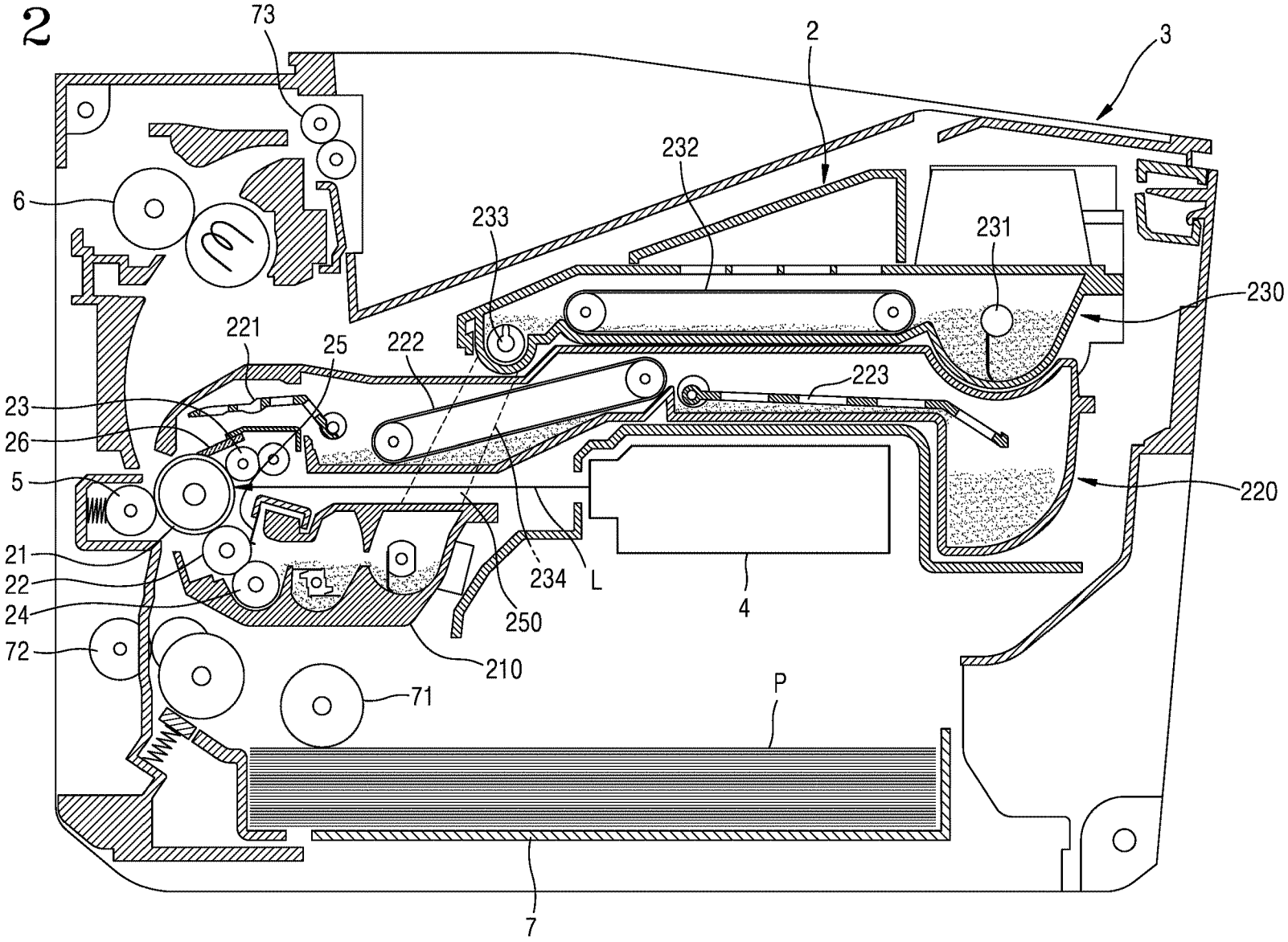
FIG. 2 is a configuration diagram of the example of the electrophotographic image forming apparatus shown in FIG. 1.
Figure 3:
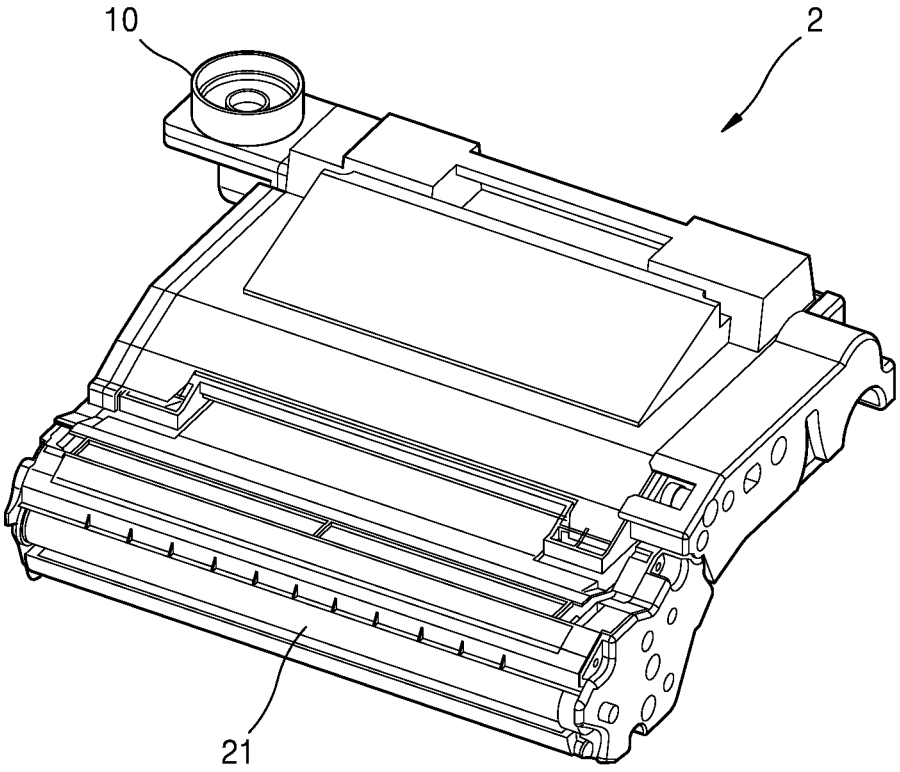
FIG. 3 is a perspective view of an example of a development cartridge adopted in the example of the electrophotographic image forming apparatus shown in FIG. 1.

FIG. 1 is an external perspective view of an example of an electrophotographic image forming apparatus. FIG. 2 is a configuration diagram of the example of the electrophotographic image forming apparatus shown in FIG. 1. FIG. 3 is a perspective view of an example of a development cartridge adopted in the example of the electrophotographic image forming apparatus shown in FIG. 1.

Referring to FIGS. 1 to 3, the electrophotographic image forming apparatus may include a main body 1 and a development cartridge 2 in the form of a cartridge removable from the main body 1. The main body 1 may be provided with a door 3. The door 3 may open and close a portion of the main body 1. FIG. 1 shows the door 3 for opening an upper portion of the main body 1, but a door for opening a side or the whole of the main body 1 may be employed. A user may open the door 3 and mount or remove the development cartridge 2 on/from the main body 1. The main body 1 may be provided with a communicating portion 8 such that the development cartridge 2 accesses from the outside of the main body 1 a toner refilling portion 10 in a state in which the development cartridge 2 is mounted on the main body 1. The communicating portion 8 may be provided at a position close to a front surface 1-2 of the main body 1. Since the front surface 1-2 faces the user, the user may easily access the communicating portion 8. Therefore, a toner refilling operation using a toner refill cartridge 9 may be easily performed through the communicating portion 8. The communicating portion 8 may be provided on an upper surface 1-1 of the main body 1. The toner refilling portion 10 may be provided under the communicating portion 8. The communicating portion 8 and the toner refilling portion 10 may be aligned in a vertical direction. The toner refill cartridge 9 may access the toner refilling portion 10 from above the main body 1 through the communicating portion 8.

A photosensitive drum 21 may include a cylindrical metal pipe and a photosensitive layer with photoconductivity formed on the periphery thereof, as an example of a photoconductor on which an electrostatic latent image is formed. A charging roller 23 is an example of a charger that charges a surface of the photosensitive drum 21 to a uniform potential. A charging bias voltage may be applied to the charging roller 23. A corona charger (not shown) may also be used instead of the charging roller 23. A developing roller 22 may supply toner to an electrostatic latent image formed on the surface of the photosensitive drum 21 to develop the electrostatic latent image.

A supply roller 24 may attach the toner to the developing roller 22. A supply bias voltage may be applied to attach the toner to the supply roller 24 with the developing roller 22. A regulating member 25 may regulate the amount of toner attached to a surface of the developing roller 22. The regulating member 25 may be, for example, a regulating blade whose tip is brought into contact with the developing roller 22 at a certain pressure. A cleaning member 26 may remove residual toner and foreign materials from the surface of the photosensitive drum 21 before charging. The cleaning member 26 may be, for example, a cleaning blade whose tip is in contact with the surface of the photosensitive drum 21. Hereinafter, the foreign materials removed from the surface of the photosensitive drum 21 are referred to as waste toner.

An optical scanner 4 may scan the surface of the photosensitive drum 21 charged to a uniform potential with light modulated according to image information. As the optical scanner 4, for example, a laser scanning unit (LSU) may be employed in which light irradiated from a laser diode is deflected in a main scanning direction by using a polygon mirror to scan the photosensitive drum 21.

A transfer roller 5 is an example of a transfer unit which is located opposite the photosensitive drum 21 to form a transfer nip. A transfer bias voltage for transferring a toner image developed on the surface of the photosensitive drum 21 to a print medium P may be applied to the transfer roller 5. A corona transferor may be used instead of the transfer roller 5.

The toner image transferred to the surface of the print medium P by the transfer roller 5 may be maintained on a surface of the print medium P by electrostatic attraction. A fixing device 6 may form a permanent print image on the print medium P by fixing the toner image on the print medium P by applying heat and pressure.

The development cartridge 2 according to the example may include a developing portion 210 provided with the photosensitive drum 21 and the developing roller 22, a waste toner accommodating portion 220 in which waste toner removed from the photosensitive drum 21 is accommodated, and a toner accommodating portion 230 connected to the developing portion 210 and accommodating toner. In order to refill toner in the toner accommodating portion 230, the development cartridge 2 may include the toner refilling portion 10 connected to the toner accommodating portion 230. The toner refilling portion 10 provides an interface between the toner refill cartridge 9 and the development cartridge 2, which will be described later below. The development cartridge 2 may be an integrated development cartridge including the developing portion 210, the waste toner accommodating portion 220, the toner accommodating portion 230, and the toner refilling portion 10.

A portion of an outer periphery of the photosensitive drum 21 may be exposed to the outside of a housing. The transfer roller 5 may contact the exposed portion of the photosensitive drum 21 to form the transfer nip. The developing portion 210 may be provided with one or more carrying members for carrying toner toward the developing roller 22. The carrying member may also stir toner to charge the toner to a certain potential.

The waste toner accommodating portion 220 may be located above the developing portion 210. The waste toner accommodating portion 220 may be spaced upward from the developing portion 210 to form a light path 250 therebetween. Waste toner removed from the surface of the photosensitive drum 21 by the cleaning member 26 may be accommodated in the waste toner accommodating portion 220. The waste toner removed from the surface of the photosensitive drum 21 may be transferred to the inside of the waste toner accommodating portion 220 by one or more transfer members 221, 222, and 223. The shape and the number of a waste toner transfer member are not limited. An appropriate number of waste toner transfer members may be provided at appropriate positions to effectively disperse waste toner in the waste toner accommodating portion 220 considering a volume or a shape of the waste toner accommodating portion 220.

The toner accommodating portion 230 may be connected to the toner refilling portion 10 to accommodate toner. The toner accommodating portion 230 may be connected to the developing portion 210 by a toner supply 234 as shown by dashed lines in FIG. 2. As shown in FIG. 2, the toner supply 234 may be connected to the developing portion 210 through the waste toner accommodating portion 220 in the vertical direction. The toner supply 234 may be located outside an effective width of exposure light L so as not to interfere with the exposure light L scanned in a main scanning direction by the optical scanner 4.

The toner accommodating portion 230 may be provided with one or more toner supply members 231, 232, and 233 for supplying toner to the developing portion 210 through the toner supply 234. The shape and the number of toner supply members are not limited. An appropriate number of toner supply members may be provided at appropriate positions in the toner accommodating portion 230 to effectively supply toner to the developing portion 210 considering a volume or a shape of the toner accommodating portion 230. The toner supply member 233 may transfer toner to the toner supply 234.

An image forming process according to the above-described configuration will be briefly described. A charging bias voltage is applied to the charging roller 23, and the photosensitive drum 21 may be charged to a uniform potential. The optical scanner 4 may scan the photosensitive drum 21 with light modulated corresponding to image information to form an electrostatic latent image on the surface of the photosensitive drum 21. The supply roller 24 may attach toner to the surface of the developing roller 22. The regulating member 25 may form a toner layer having a uniform thickness on the surface of the developing roller 22. A developing bias voltage may be applied to the developing roller 22. Toner carried to the developing nip as the developing roller 22 is rotated is moved and attached to the electrostatic latent image formed on the surface of the photosensitive drum 21 by the developing bias voltage so that a visible toner image may be formed on the surface of the photosensitive drum 21. The print medium P drawn out from a loading unit 7 by a pickup roller 71 may be transferred to the transfer nip where the transfer roller 5 and the photosensitive drum 21 face each other by a feed roller 72. When a transfer bias voltage is applied to the transfer roller 5, the toner image may be transferred to the print medium P by electrostatic attraction. The toner image transferred to the print medium P is fixed to the print medium P by receiving heat and pressure from the fixing device 6, whereby printing may be completed. The print medium P is discharged by a discharge roller 73. Toner remaining on the surface of the photosensitive drum 21 without being transferred to the print medium P may be removed by the cleaning member 26.

According to an image forming apparatus of the example, the development cartridge 2 may include the toner refilling portion 10 in order to refill toner in the development cartridge 2 in a state in which the development cartridge 2 is mounted on the main body 1 without removing the development cartridge 2 from the main body 1. The toner refilling portion 10 may be integrally formed with the development cartridge 2 and may be detached from the main body 1 together with the development cartridge 2.

Figure 4:
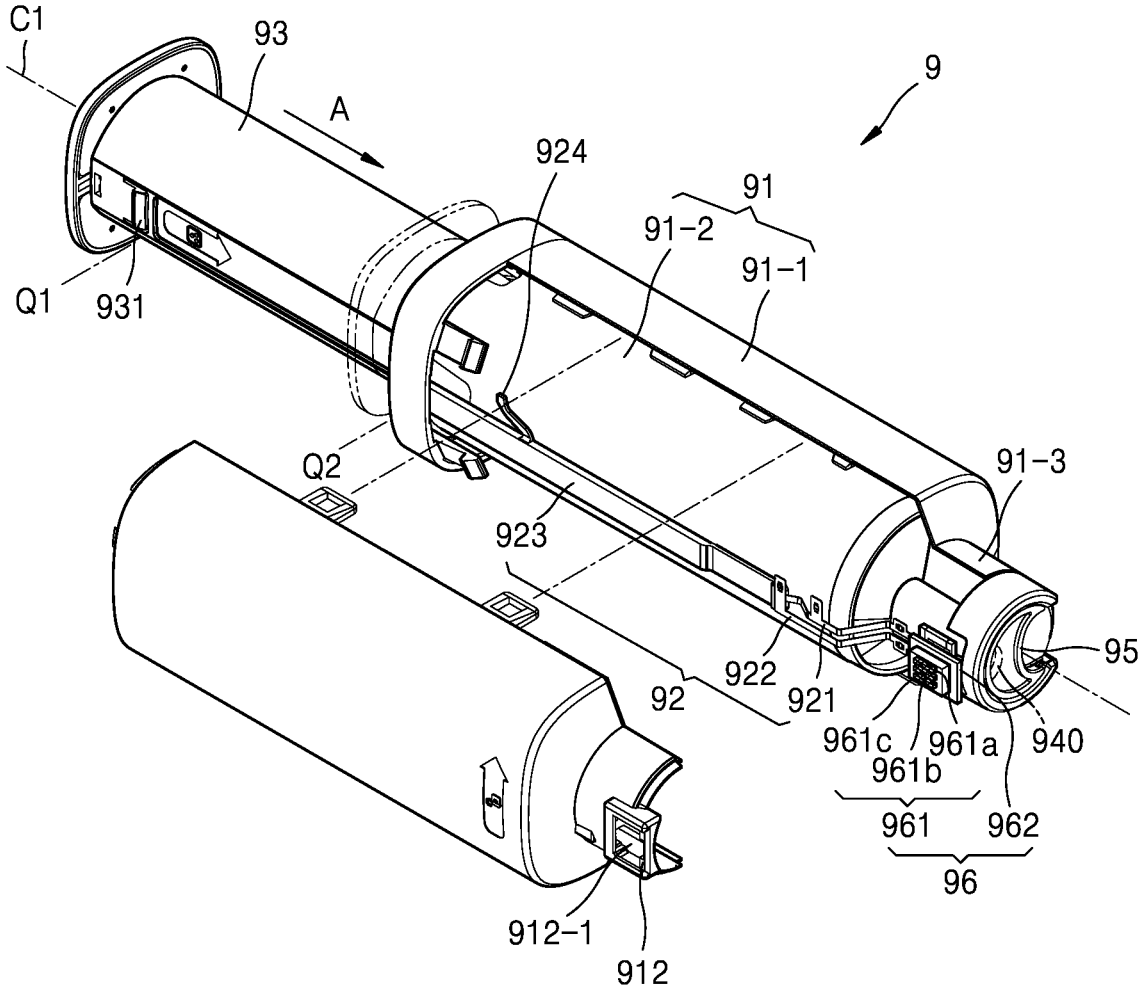
FIG. 4 is a partially exploded perspective view of an example of a toner refill cartridge.
Figure 5A:
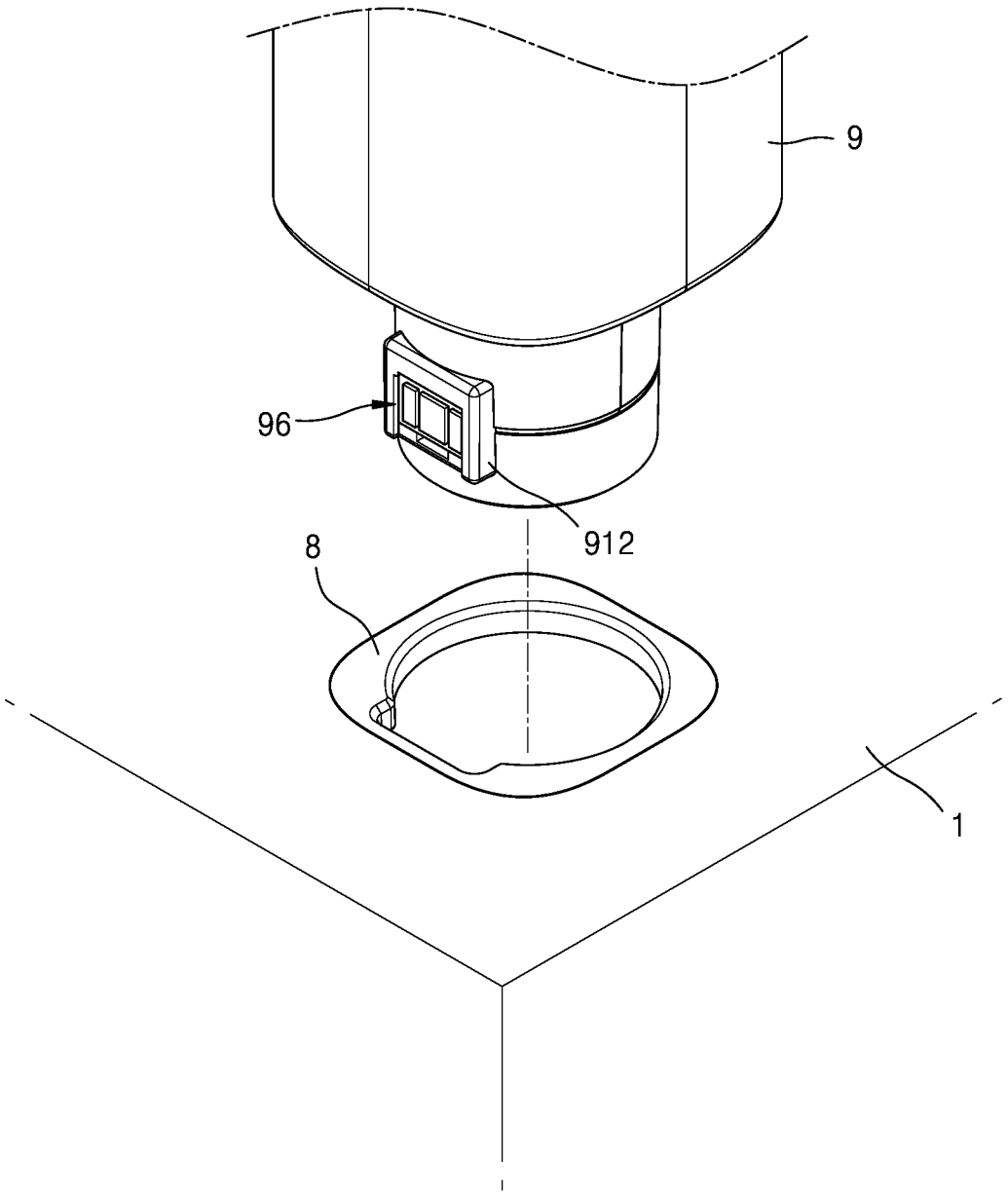
FIGS. 5A and 5B are views of a toner refill cartridge which accesses a toner refilling portion from the outside of a main body of an image forming apparatus through a communicating portion.
Figure 5B:
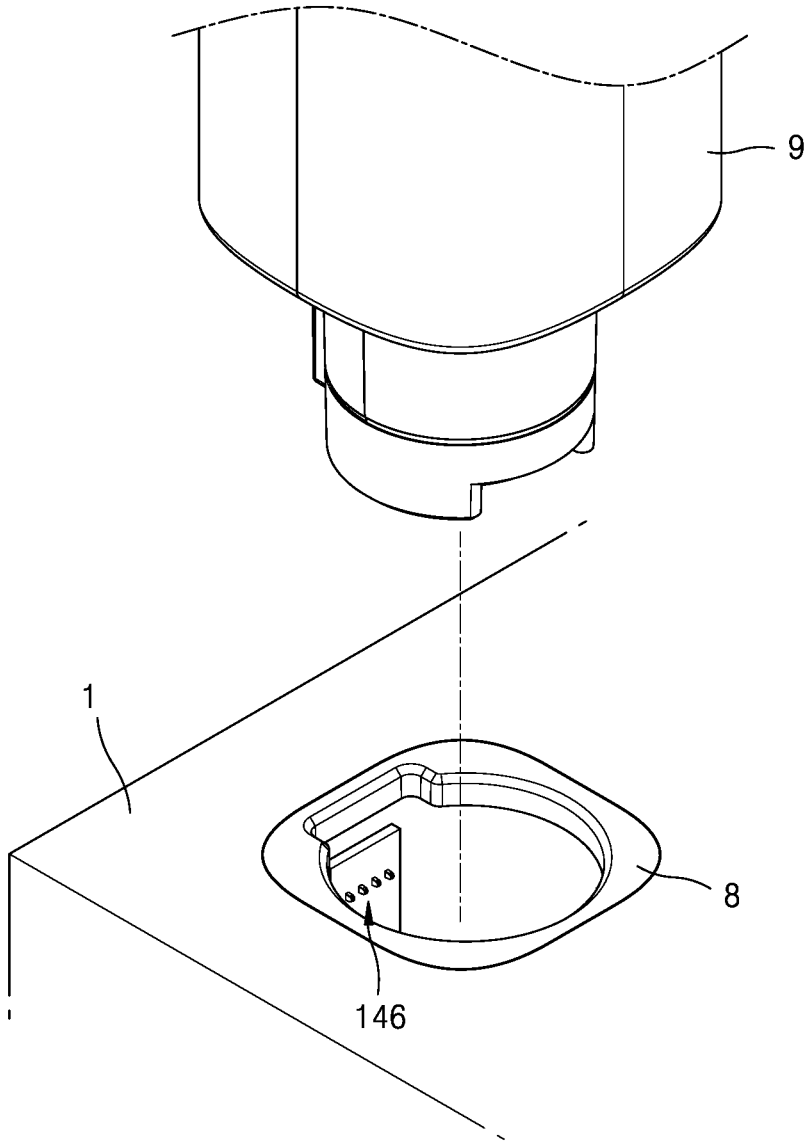
Figure 6:
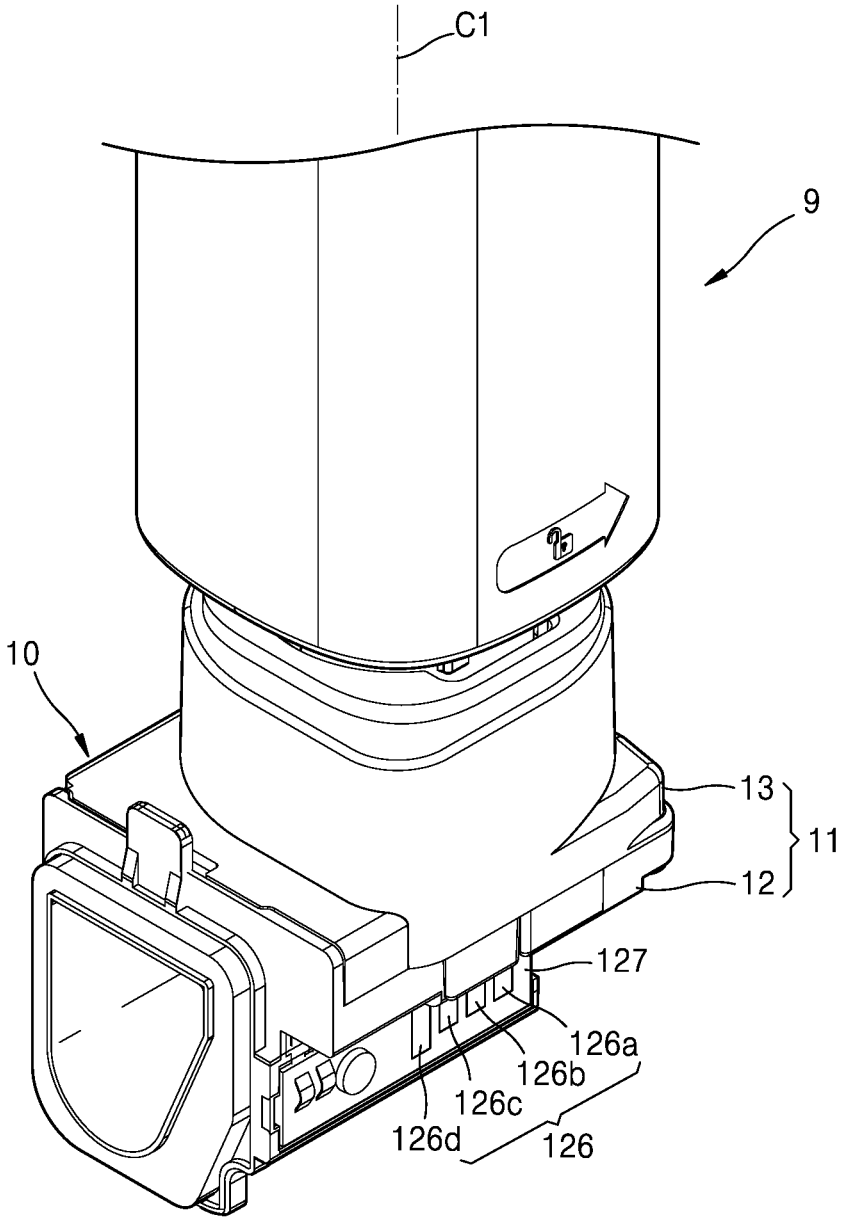
FIG. 6 is a perspective view of an example of a toner refilling portion equipped with a toner refill cartridge.
Figure 7:
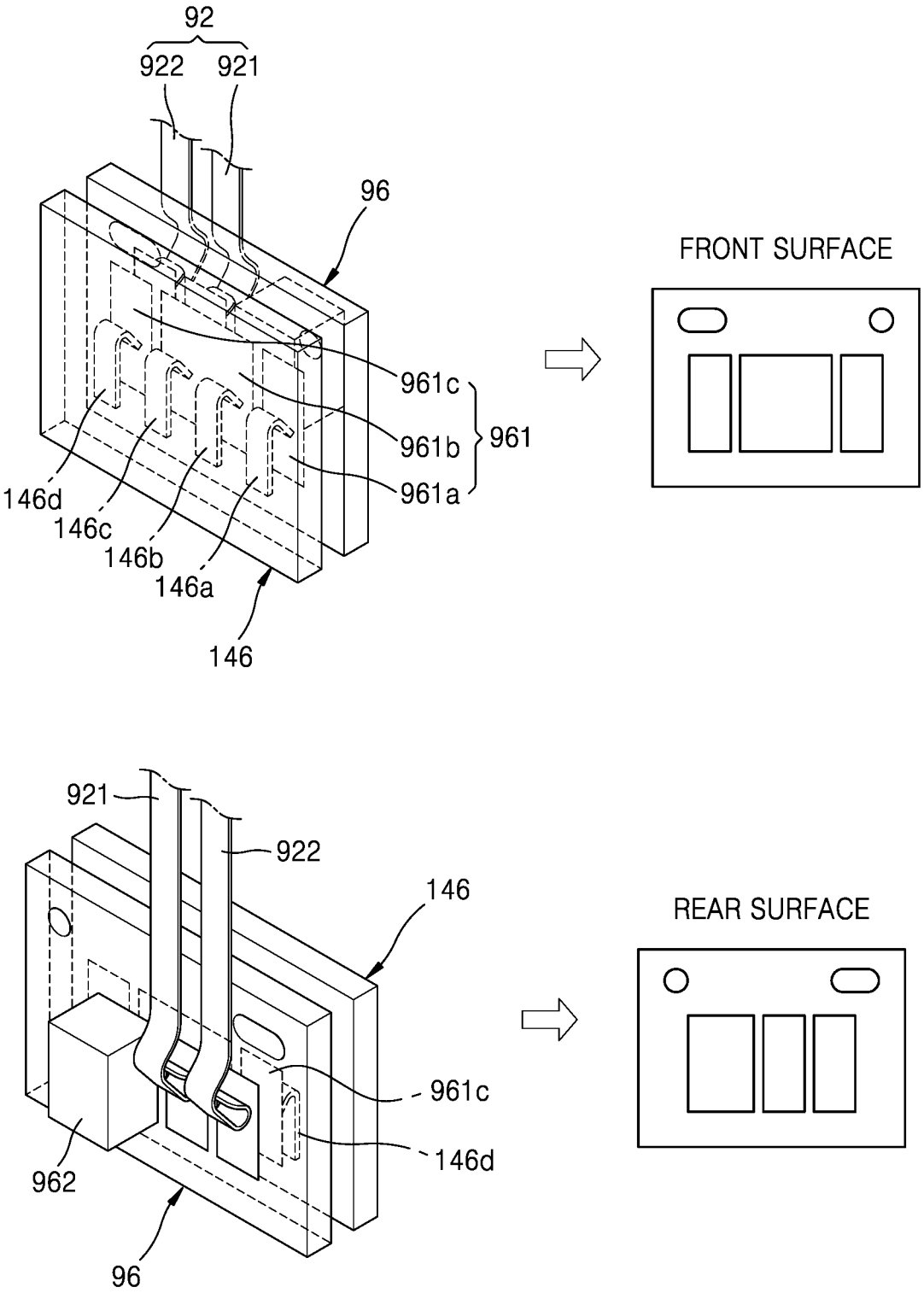
FIG. 7 is a view for explaining electrical connection between a connection interface of a toner refill cartridge and a first connector of a toner refilling portion.

FIG. 4 is a perspective view of an example of the toner refill cartridge 9. FIGS. 5A and 5B are views of the toner refill cartridge 9 which accesses the toner refilling portion 10 from the outside of the main body 1 of the image forming apparatus through the communicating portion 8. FIG. 6 is a perspective view of an example of the toner refilling portion 10 equipped with the toner refill cartridge 9. FIG. 7 is a view for explaining electrical connection between a connection interface 96 of the toner refill cartridge 9 and a first connector 146 of the toner refilling portion 10.

Referring to FIGS. 4 to 7, the toner refill cartridge 9 may be a syringe toner refill cartridge including a body 91 accommodating toner and having a toner discharge portion 940, and a plunger 93 which is movably coupled to the body 91 in a longitudinal direction A to push toner out of the body 91. The toner discharge portion 940 may be provided at a tip portion 91-3 of the body 91. A discharge shutter 95 may selectively open and close the toner discharge portion 940. A protruding portion 912 partially protruding outwardly may be provided at the tip portion 91-3 of the body 91.

The body 91 may include an outer body 91-1 and an inner body 91-2 located inside the outer body 91-1 and accommodating toner. The toner discharge portion 940 is provided in the inner body 91-2. The plunger 93 may be inserted into the inner body 91-2 and moved in the longitudinal direction A. The plunger 93 may be moved from an upper position Q1 to a lower position Q2. The discharge shutter 95 may be provided so as to be independently rotatable with respect to the tip portion 91-3 of the body 91. For example, as shown in FIG. 4, the discharge shutter 95 may be located in a closed position that blocks the toner discharge portion 940. Further, the discharge shutter 95 may be located at a discharge position where the discharge shutter 95 is rotated 180 degrees with respect to the body 91 to open the toner discharge portion 940. The discharge shutter 95 may be rotated with respect to a first rotation axis C1. The first rotation axis C1 may be, for example, a central axis of the cylindrical tip portion 91-3.

The toner refill cartridge 9 may be provided with a toner injection completion signal generator 92 used for detecting completion of injection of toner. For example, referring to the example of FIG. 4, the toner injection completion signal generator 92 may include a pair of electrodes 921 and 922 provided between the outer body 91-1 and the inner body 91-2. The pair of electrodes 921 and 922 may be respectively connected to electrical contacts 961*b* and 961*c*. An electrical contact state of the pair of electrodes 921 and 922 may vary depending on a position of the plunger 93. The electrical contact state of the pair of electrodes 921 and 922 may change from a first state to a second state when the plunger 93 reaches the lower position Q2. For example, the first state and the second state may be an electrically open state and an electrically short state, respectively, or vice versa. An operating lever 923 movable in the longitudinal direction A may be provided between the outer body 91-1 and the inner body 91-2 in order to change the electrical contact state of the pair of electrodes 921 and 922. The plunger 93 may include a pushing protrusion 931 which pushes the operating lever 923 when the plunger 93 reaches the lower position Q2 to bring the pair of electrodes 921 and 922 into contact with or spaced from each other.

A connection interface 96 may be provided at the tip portion 91-3 of the body 91. When the toner refill cartridge 9 is mounted on the toner refilling portion 10, the connection interface 96 may be electrically connected to the main body 1 to transfer information of the toner refill cartridge 9 to the main body 1. In the example, the connection interface 96 may be electrically connected to the main body 1 via the first connector 146 provided in the toner refilling portion 10. The main body 1, for example, a controller provided in the main body 1, may determine whether or not the toner refill cartridge 9 is mounted depending on whether the controller is electrically connected to the connection interface 96, for example, whether the controller can communicate with the connection interface 96.

The connection interface 96 may include a circuit unit 962 for managing information of the toner refill cartridge 9 and an electrical contact portion 961 for connection with the main body 1. The circuit unit 962 may be a customer replaceable unit monitor (CRUM) including a processor for performing at least one of authentication and/or encrypted data communication with the main body 1. The circuit unit 962 may further include a memory. The memory may store various types of information for the toner refill cartridge 9. For example, information about a manufacturer, information about manufacturing date and time, unique information such as serial number, model name, and the like, various programs, digital signature information, and a usage state (e.g., how many sheets have been printed so far, how many remaining sheets can be printed, and how much toner is remaining) may be stored in the memory. In addition, information about a lifetime of the toner refill cartridge 9, setup menu, and the like may be stored in the memory. In addition, the circuit unit 962 may include functional blocks capable of performing various functions for communication authentication, encryption, and the like with the main body 1. The circuit unit 962 may be implemented in the form of a chip including a processor and/or a memory, or a printed circuit board assembly (PBA) in which circuit elements for implementing chips and various functional blocks are mounted.

The electrical contact portion 961 may have various forms such as a conductive pattern, a modular jack, a resilient terminal, and the like, which may be electrically connected to the main body 1. The electrical contact portion 961 of the example shown in FIG. 4 is a conductive pattern. The electrical contact portion 961 may be exposed to the outside of the body 91 through an opening 912-1 provided in the protruding portion 912.

For example, the electrical contact portion 961 may have three electrical contacts 961*a*, 961*b*, and 961*c*. The first electrical contact 961*a* may be for transmitting information stored in the memory of the circuit unit 962 to the main body 1 of the image forming apparatus. The second electrical contact 961*b* may be for transmitting a signal regarding whether or not the toner refill cartridge 9 is mounted on the toner refilling portion 10 to the main body 1 of the image forming apparatus. The third electrical contact 961*c* may be for transmitting a toner injection completion signal or a removal request signal of the toner refill cartridge 9 to the main body 1 of the image forming apparatus.

As shown in FIGS. 5A and 5B, the toner refill cartridge 9 may be mounted on the toner refilling portion 10 through the communicating portion 8 from the outer surface of the main body 1 of the image forming apparatus. FIG. 5A is a front view of the toner refill cartridge 9 when the toner refill cartridge 9 accesses the communicating portion 8. FIG. 5B is a rear view of the toner refill cartridge 9 when the toner refill cartridge 9 accesses the communicating portion 8. When the toner refill cartridge 9 is inserted into the communicating portion 8 from above the main body 1, the toner refill cartridge 9 may be mounted on the toner refilling portion 10 as shown in FIG. 6. When the plunger 93 of the toner refill cartridge 9 is pushed in the longitudinal direction A of the body 91 in a state in which the toner refill cartridge 9 is mounted on the toner refilling portion 10, toner accommodated in the body 91 may be discharged through the toner discharge portion 940 and supplied to the toner accommodating portion 230 of the development cartridge 2 through the toner refilling portion 10. The toner refill cartridge 9 may be removed from the communicating portion 8 after toner injection completion.

When the toner refill cartridge 9 is mounted on the toner refilling portion 10 of the image forming apparatus, the connection interface 96 of the toner refill cartridge 9 may be electrically connected to the first connector 146 located at a certain portion of the toner refilling portion 10. The connection interface 96 of the toner refill cartridge 9 may be electrically connected to the main body 1, for example, a controller provided in the main body 1 through the first connector 146 and a second connector 127 provided in the toner refilling portion 10. When the toner refill cartridge 9 is mounted on a mounting portion 11 through an insertion portion of an upper body 13, the first connector 146 may be directly connected to the electrical contact portion 961 of the connection interface 96. The first connector 146 may be connected to the second connector 127 by a flexible cable and the second connector 127 may be electrically connected to the controller provided in the main body 1.

Referring to FIGS. 6 and 7, the electrical contact portion 961 including the three electrical contacts 961*a*, 961*b*, and 961*c* may be provided on a front surface of the connection interface 96 and the circuit unit 962 including a memory for storing information about the toner refill cartridge 9 may be implemented on a rear surface of the connection interface 96. The first connector 146 may be provided with the four electrical contacts 146*a*, 146*b*, 146*c*, and 146*d*. The four electrical contacts 146*a*, 146*b*, 146*c*, and 146*d* of the first connector 146 may correspond to the three electrical contacts 961*a*, 961*b*, and 961*c* of the connection interface 96. For example, the first electrical contact 961*a* of the connection interface 96 may be electrically connected to the first electrical contact 146*a* of the first connector 146. The electrical contact 961*b* of the connection interface 96 may be electrically connected to the second electrical contact 146*b* and/or the third electrical contact 146*c* of the first connector 146. The third electrical contact 961*c* of the connection interface 96 may be electrically connected to the fourth electrical contact 146*d* of the first connector 146. The four electrical contacts 146*a*, 146*b*, 146*c*, and 146*d* may be electrically connected to the mounting portion 11, for example, the second connector 127 provided on a lower body 12 by the flexible cable. Thus, stable electrical connection between the first connector 146 and the second connector 127 may be maintained. The second connector 127 may include an electrical contact portion 126, and the electrical contact portion 126 may include four electrical contacts 126*a*, 126*b*, 126*c*, and 126*d*. The four electrical contacts 146*a*, 146*b*, 146*c*, and 146*d* of the first connector 146 may be electrically connected to the four electrical contacts 126*a*, 126*b*, 126*c*, and 126*d* of the second connector 127 by a flexible cable, respectively. As a result, when the toner refill cartridge 9 is mounted on the mounting portion 11, the second connector 127 may be electrically connected to the connection interface 96 of the toner refill cartridge 9 through the first connector 146 of the toner refilling portion 10.

Figure 8:
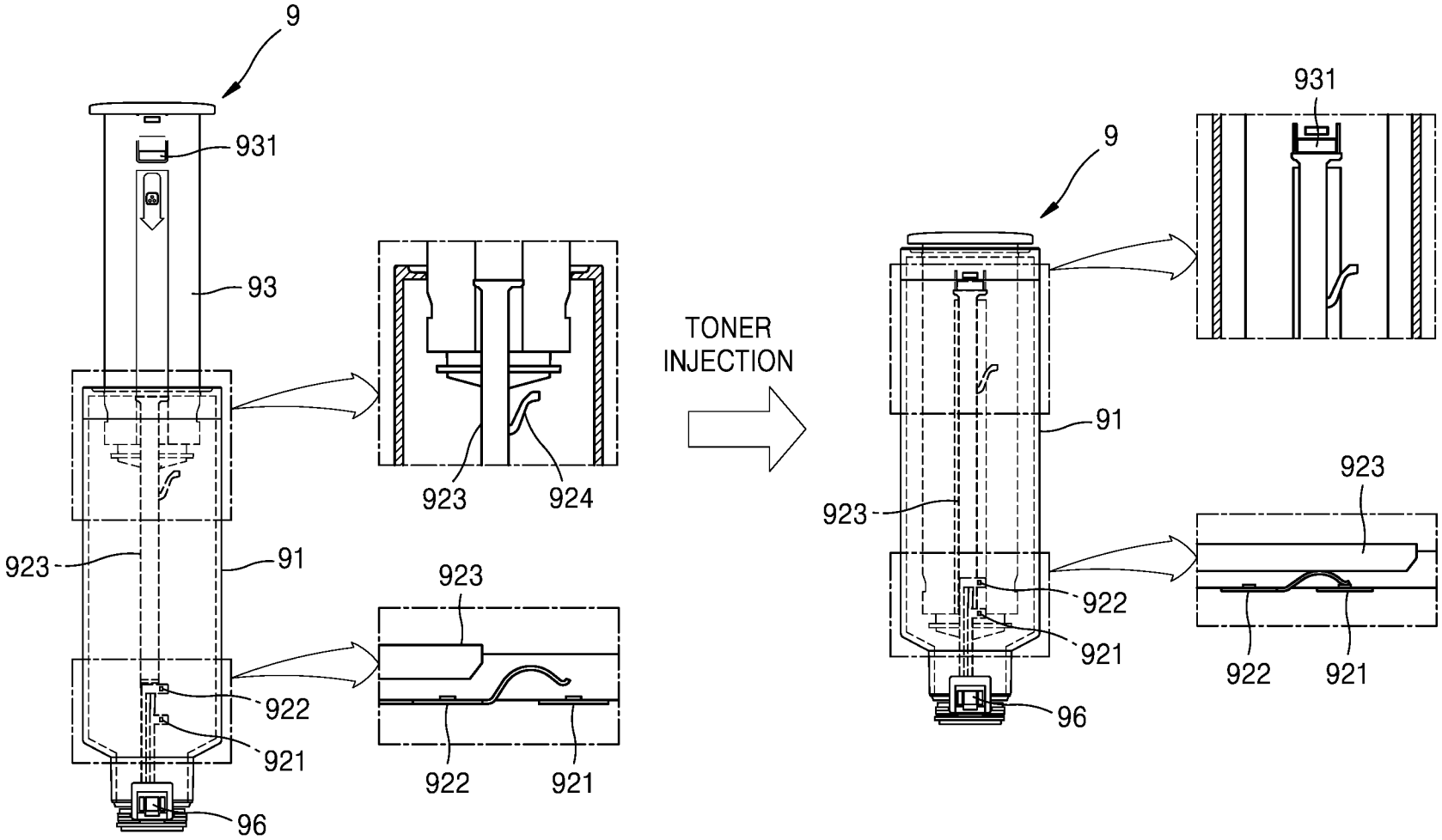
FIGS. 8 to 10 are views for explaining operations of examples of a toner refill cartridge for generating a toner injection completion signal when toner injection into the toner refill cartridge is completed.
Figure 9:
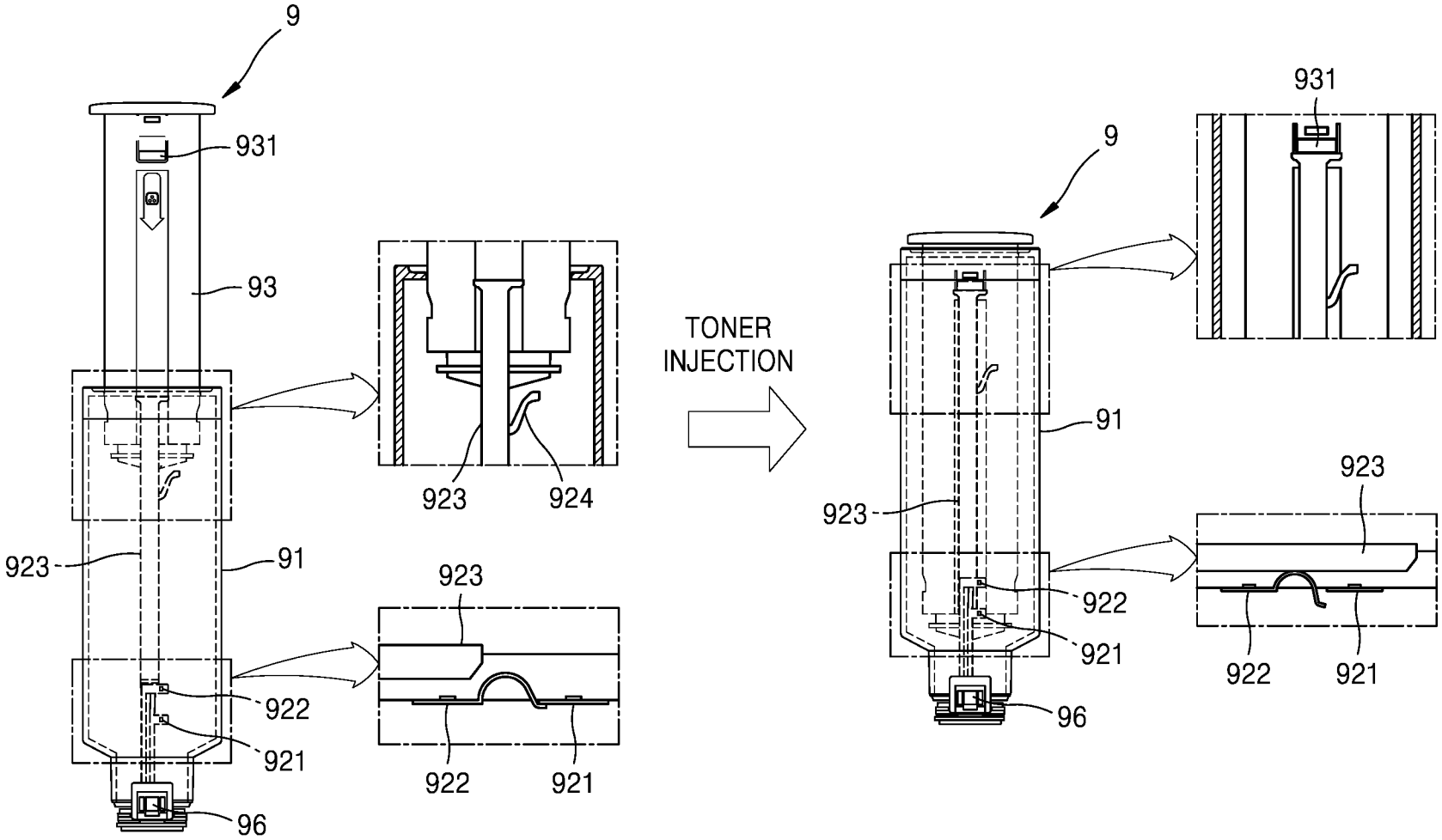
Figure 10:
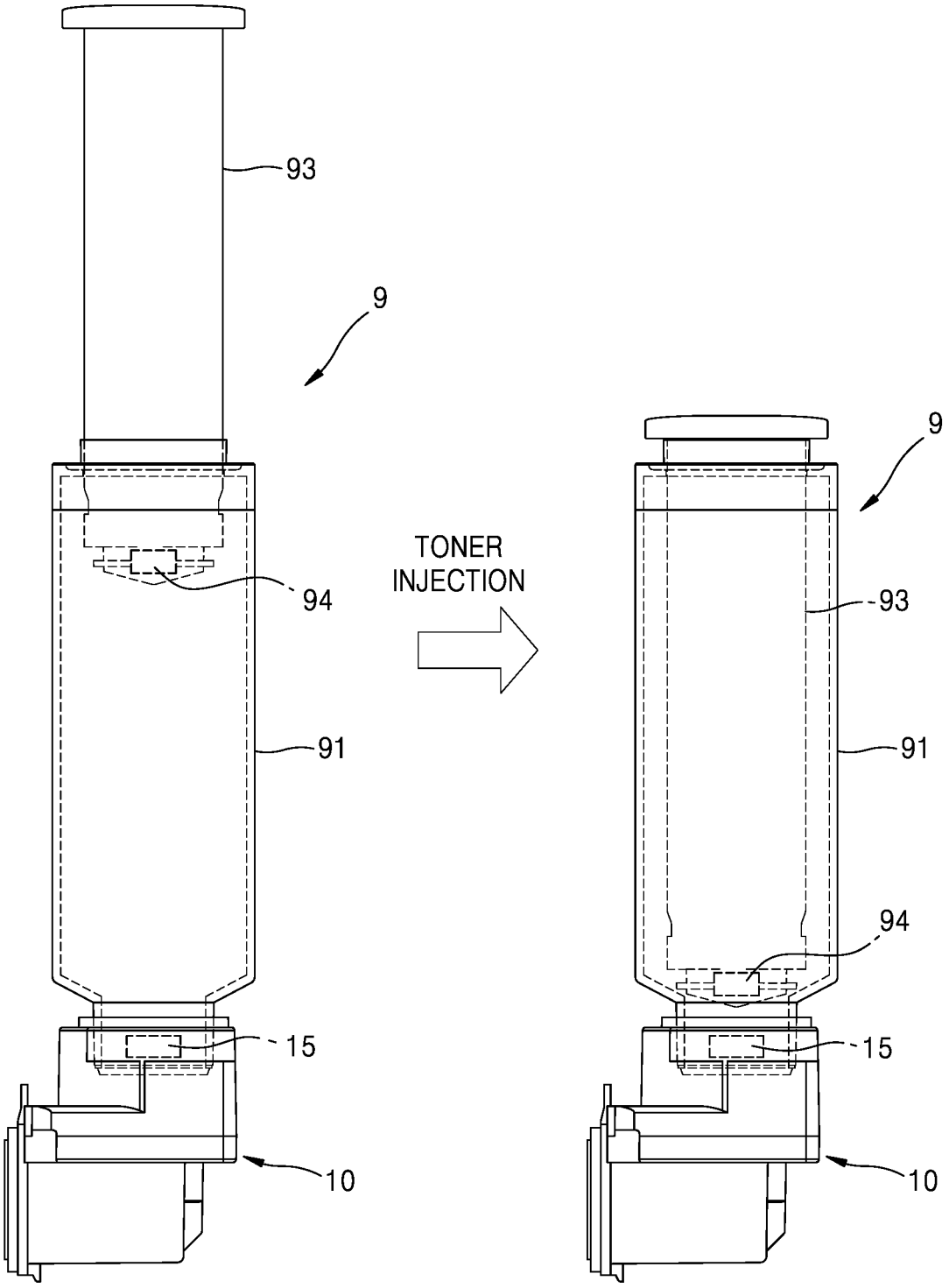

FIGS. 8 to 10 are views for explaining operations of examples of the toner refill cartridge 9 for generating a toner injection completion signal when toner injection into the toner refill cartridge 9 is completed.

When the toner refill cartridge 9 is mounted on the image forming apparatus, the image forming apparatus may confirm completion of mounting of the toner refill cartridge 9 based on electrical connection between the toner refill cartridge 9 and the image forming apparatus described above, and may authenticate the mounted toner refill cartridge 9. Thereafter, when a user pushes the plunger 93 of the toner refill cartridge 9 mounted on the image forming apparatus, toner may be supplied to the toner accommodating portion 230 of the development cartridge 2 through the toner refilling portion 10 from the toner refill cartridge 9. The image forming apparatus may determine whether toner injection is completed such that a certain amount of toner may be properly refilled from the toner refill cartridge 9. Hereinafter, a manner in which the image forming apparatus determines the completion of the toner injection will be described with reference to FIGS. 8 to 10.

The toner refill cartridge 9 of FIGS. 8 to 10 may include the body 91 accommodating toner and the plunger 93 inserted into the body 91 and movably coupled to the body 91 in a longitudinal direction of the body 91 and pushing the toner out of the body 91. Also, the toner refill cartridge 9 may include the toner injection completion signal generator 92 and the connection interface 96. The toner injection completion signal generator 92 is used to detect whether the toner injection is completed according to movement of the plunger 93. The connection interface 96, which is located at the tip portion 91-3 of the body 91, is connected to the image forming apparatus to transfer information about the toner refill cartridge 9 to the image forming apparatus. The information about the toner refill cartridge 9 may be at least one of information related to the toner refill cartridge 9, a signal indicating the completion of mounting of the toner refill cartridge 9, and the toner injection completion signal of the toner refill cartridge 9. The connection interface 96 may include the circuit unit 962 including a memory for storing at least one of unique information, state information, and specification information of the toner refill cartridge 9, and the electrical contact portion 961 including a plurality of electrical contacts electrically connected to the image forming apparatus. The toner injection completion signal generator 92 may generate the toner injection completion signal based on a position of the plunger 93 at the time of completion of injection of toner. The toner injection completion signal may be various kinds of signals such as an electric signal and a magnetic field signal.

Referring to FIGS. 8 and 9, the toner refill cartridge 9 may have the toner injection completion signal generator 92 including the pair of electrodes 921 and 922 connected to the connection interface 96, and the operating lever 923, which moves in the longitudinal direction of the body 91 by the pushing protrusion 931 provided in the plunger 93 and changes an electrical contact state of the pair of electrodes 921 and 922. A hooking member 924 provided on the operating lever 923 may be locked and fixed to a protruding portion formed on the body 91 until the plunger 93 reaches a certain position.

In an example shown in FIG. 8, the pair of electrodes 921 and 922 is kept spaced apart from each other before the toner refill cartridge 9 completes toner injection. When the plunger 93 is moved in the longitudinal direction A and reaches the lower position Q2, the pair of electrodes 921 and 922 may be brought into contact with each other. The pushing protrusion 931 provided in the plunger 93 pushes the operating lever 923 in accordance with movement of the plunger 93 so that ends of the pair of electrodes 921 and 922 may be brought into contact with each other when the plunger 93 reaches the lower position Q2. The operating lever 923 is pushed by the pushing protrusion 931 from the time when the plunger 93 reaches the certain position and may bring the pair of electrodes 921 and 922 spaced apart from each other on a moving path of the operating lever 923 into contact with each other.

In an example shown in FIG. 9, the pair of electrodes 921 and 922 is kept in contact with each other before the toner refill cartridge 9 completes toner injection. When the plunger 93 is moved in the longitudinal direction A and reaches the lower position Q2, ends of the pair of electrodes 921 and 922 may be spaced apart from each other. The pushing protrusion 931 provided in the plunger 93 pushes the operating lever 923 in accordance with movement of the plunger 93 and may separate ends of the pair of electrodes 921 and 922 from each other when the plunger 93 reaches the lower position Q2. The operating lever 93 is pushed by the pushing protrusion 931 from the time when the plunger 93 reaches the certain position and may separate the pair of electrodes 921 and 922 that are in contact with each other on the moving path of the operating lever 923 from each other. For example, the operating lever 923 may break a contact portion of the pair of electrodes 921 and 922 that are in contact with each other and separate the pair of electrodes 921 and 922 from each other.

Referring to FIG. 10, the toner refill cartridge 9 may include the toner injection completion signal generator 92 including a magnetic substance 94 which is contained in a tip portion of the plunger 93 inserted into the body 91 and whose position in the body 91 is determined by movement of the plunger 93.

In an example shown in FIG. 10, when the plunger 93 is moved for injecting toner in the toner refill cartridge 9, the position of the magnetic substance 94 contained in the tip portion of the plunger 93 in the body 91 may be determined according to a movement position of the plunger 93. When the plunger 93 is moved in the longitudinal direction A and reaches the lower position Q2, a proximity sensor 15 provided at a certain position of the toner refilling portion 10 may detect the magnetic substance 94 contained in the plunger 93. The proximity sensor 15 may detect the toner injection completion signal when the magnetic substance 94 contained in the plunger 93 is within a certain distance from the proximity sensor 15 and a voltage exceeding a certain level is generated. The proximity sensor 15 may be a hall sensor used for position sensing.

Meanwhile, a image forming apparatus 100, on which the toner refill cartridge 9 shown in FIGS. 8 to 10 is mounted may include the main body 1, the development cartridge 2, the toner refilling portion 10, and a controller (not shown). The development cartridge 2 may supply toner accommodated in the toner accommodating portion 230 to an electrostatic latent image formed on a photoconductor to form a toner image, and may be removable from the main body 1. The toner refilling portion 10 may be connected to the toner accommodating portion 230, and the toner refill cartridge 9 for refilling toner in the toner accommodating portion 230 may be mounted on the toner refilling portion 10. The controller (not shown), with the development cartridge 2 mounted on the main body 1, may determine the completion of mounting of the toner refill cartridge 9 or the toner injection completion based on a signal received from the toner refill cartridge 9 mounted on the toner refilling portion 10.

When the toner refill cartridge 9 described with reference to FIGS. 8 and 9 is mounted on the toner refilling portion 10, the controller may determine the signal indicating the completion of mounting of the toner refill cartridge 9 or the toner injection completion signal of the toner refill cartridge 9 according to a voltage level of the signal received from the toner refill cartridge 9.

When the toner refill cartridge 9 described with reference to FIG. 10 is mounted on the toner refilling portion 10, the toner refilling portion 10 may further include the proximity sensor 15 for detecting the magnetic substance 94 contained in the plunger 93 inserted into the body 91 of the toner refill cartridge 9 and moved in the longitudinal direction of the body 91. The controller (not shown) may determine the toner injection completion based on a detection signal received from the proximity sensor 15.

The image forming apparatus 100 on which the toner refill cartridge 9 is mounted may further include a user interface (not shown). The controller (not shown), when mounting of the toner refill cartridge 9 is completed, may control the user interface (not shown) to display that toner injection is possible upon the completion of mounting of the toner refill cartridge 9. Furthermore, the controller (not shown), when toner injection of the toner refill cartridge 9 is completed, may delete information related to the toner refill cartridge 9 stored in the memory of the toner refill cartridge 9 and control the user interface (not shown) to display that the toner refill cartridge 9 is removable. The user interface (not shown) may also output information about the completion of mounting of the toner refill cartridge 9 or the toner injection completion.

It should be understood that the disclosure described herein should be considered in a descriptive sense and is not limiting. Descriptions of features within each example should be considered as available for other similar features in other examples. Therefore, the scope of the disclosure is defined not by the detailed description of the disclosure but by the appended claims.

What is claimed is:

1. A toner refill cartridge, comprising:
a body in which toner is accommodated;
a plunger inserted into the body and movably coupled to the body in a longitudinal direction of the body to push the toner out of the body;
a toner injection completion signal generator to indicate toner injection completion according to movement of the plunger; and
a connection interface located at a tip portion of the body and connectable to an image forming apparatus to transfer information about the toner refill cartridge to the image forming apparatus.

2. The toner refill cartridge of claim 1, wherein the toner injection completion signal generator is to generate a toner injection completion signal based on a position of the plunger at a time of the toner injection completion.

3. The toner refill cartridge of claim 1, wherein the toner injection completion signal generator includes:
a first electrode connected to the connection interface,
a second electrode connected to the connection interface, and
an operating lever, movable in the longitudinal direction of the body by a pushing protrusion provided in the plunger, to change an electrical contact state of the first electrode and the second electrode.

4. The toner refill cartridge of claim 3, wherein
when the plunger is at a first position the first electrode and the second electrode are spaced apart from one another along a moving path of the operating lever, and
when the pushing protrusion pushes the operating lever such that the plunger is positioned at a second position, the operating lever brings the first electrode and the second electrode into contact with one another.

5. The toner refill cartridge of claim 3, wherein
when the plunger is at a first position the first electrode and the second electrode are in contact with one another along a moving path of the operating lever, and
when the pushing protrusion pushes the operating lever such that the plunger is positioned at a second position, the operating lever separates the first electrode from the second electrode.

6. The toner refill cartridge of claim 5, wherein the operating lever is to break a contact portion of the first electrode and the second electrode to separate the first electrode from the second electrode.

7. The toner refill cartridge of claim 3, wherein the operating lever includes a hooking member locked and fixed to a protruding portion formed on the body until the plunger reaches a predetermined position.

8. The toner refill cartridge of claim 1, wherein the toner injection completion signal generator includes a magnetic substance contained in a tip portion of the plunger, and the magnetic substance indicates toner injection completion based on a position of the magnetic substance in the body which is determined by movement of the plunger.

9. The toner refill cartridge of claim 1, wherein the connection interface includes:

a circuit unit including a memory to store at least one of unique information, state information, or specification information of the toner refill cartridge, and an electrical contact portion including a plurality of electrical contacts electrically connectable to the image forming apparatus.

10. The toner refill cartridge of claim 1, wherein the information about the toner refill cartridge includes at least one of information related to usage of the toner refill cartridge, identification information of the toner refill cartridge, a signal indicating completion of mounting of the toner refill cartridge, or a toner injection completion signal of the toner refill cartridge.

11. An image forming apparatus, comprising:

a main body having a space therein to mount a development cartridge on the main body, the development cartridge to supply toner accommodated in a toner accommodating portion to an electrostatic latent image formed on a photoconductor to form a toner image, and the development cartridge including a toner refilling portion connected to the toner accommodating portion and on which a toner refill cartridge for refilling toner in the toner accommodating portion is mountable;

a communicating portion provided in the main body and through which the toner refill cartridge is to access the toner refilling portion when the development cartridge is mounted on the main body and the toner refill cartridge is to be mounted on the toner refilling portion; and a controller to determine, when the development cartridge is mounted on the main body and the toner refill cartridge is mounted on the toner refilling portion, completion of mounting of the toner refill cartridge or toner injection completion based on a signal received from the toner refill cartridge.

12. The image forming apparatus of claim 11, wherein the controller is to determine the completion of the mounting of the toner refill cartridge or the toner injection completion according to a voltage level of the signal received from the toner refill cartridge.

13. The image forming apparatus of claim 11, wherein the toner refilling portion includes a proximity sensor to detect a magnetic substance contained in a plunger of the toner refill cartridge, and the controller is to determine the toner injection completion based on a detection signal received from the proximity sensor.

14. The image forming apparatus of claim 11, further comprising a user interface, wherein when the controller determines mounting of the toner refill cartridge is completed based on the signal received from the toner refill cartridge, the controller is to control the user interface to display that toner injection is possible.

15. The image forming apparatus of claim 11, further comprising a user interface, wherein when the controller determines toner injection of the toner refill cartridge is completed based on the signal received from the toner refill cartridge, the controller is to delete information related to the toner refill cartridge stored in a memory of the toner refill cartridge and control the user interface to display that the toner refill cartridge is removable.

* * * * *